US007017217B2

(12) United States Patent
Johanski et al.

(10) Patent No.: US 7,017,217 B2
(45) Date of Patent: Mar. 28, 2006

(54) WASHING MACHINE RINSE CYCLE METHOD AND APPARATUS

(75) Inventors: Brian Johanski, Louisville, KY (US); Christopher Gregory Hoppe, Louisville, KY (US); Mark Aaron Weaver, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 491 days.

(21) Appl. No.: 10/064,499

(22) Filed: Jul. 22, 2002

(65) Prior Publication Data

US 2004/0010860 A1 Jan. 22, 2004

(51) Int. Cl.
*D06F 35/00* (2006.01)

(52) U.S. Cl. ..... 8/158; 8/159

(58) Field of Classification Search ..... 8/158, 8/159

See application file for complete search history.

(56) References Cited

U.S. PATENT DOCUMENTS 3,620,053 A 11/1971 Dunn
4,225,992 A * 10/1980 Morey ..... 8/158
4,464,914 A 8/1984 Torita
5,167,722 A 12/1992 Pasrtyk et al.
5,191,668 A 3/1993 Euler et al.
5,199,127 A * 4/1993 Van Newenhizen et al. .... 8/158
5,233,718 A * 8/1993 Hardaway et al. ..... 8/158
5,504,955 A 4/1996 Mueller et al.
5,606,877 A 3/1997 Hashimoto
5,687,440 A 11/1997 Min et al.
5,737,790 A * 4/1998 Badger et al. ..... 8/158
5,743,115 A 4/1998 Hashimoto
5,758,377 A 6/1998 Cimetta et al.
5,768,730 A * 6/1998 Matsumoto et al. ..... 8/159
6,029,298 A 2/2000 Dausch et al.
6,125,490 A 10/2000 Reichamn et al.

* cited by examiner

*Primary Examiner*—Michael Barr
*Assistant Examiner*—Saeed Chaudhry
(74) *Attorney, Agent, or Firm*—George Rideout, Jr.; Armstrong Teasdale LLP

(57) ABSTRACT

An apparatus and method for operating a washing machine in a rinse cycle is provided for a washing machine including a rotatable basket and a fresh water spraying device. The method comprises rotating the basket at a first rate of rotation, spraying water into the basket while the basket is rotating at the first rate, and rotating the basket at a second rate of rotation, the second rate of rotation greater than the first rate of rotation.

15 Claims, 4 Drawing Sheets

WASHING MACHINE RINSE CYCLE METHOD AND APPARATUS

BACKGROUND OF INVENTION

This invention relates generally to washing machines, and, more particularly, to methods and apparatus for reducing water consumption in washing machine rinse cycles.

Washing machines typically include a cabinet that houses an outer tub for containing wash and rinse water, a perforated clothes basket within the tub, and an agitator within the basket. A drive and motor assembly is mounted underneath the stationary outer tub to rotate the clothes basket and the agitator relative to one another, and a pump assembly pumps water from the tub to a drain to execute a wash cycle. See, for example, U.S. Pat. No. 6,029,298.

Traditionally, rinse portions of wash cycles include a deep-fill process wherein articles in the clothes basket are completely submerged in water and the water is agitated. As such, a large amount of water mixes with detergent remaining in the clothes after they are washed. While the concentration of detergent in the water is relatively small, a large amount of detergent can be removed from the clothes due to the large amount of water involved. It has become increasingly desirable, however, to reduce water consumption in washing operations.

At least some types of washing machines have reduced water consumption in rinsing operation by using re-circulating rinse water flow. In this type of system, rinse water is collected in a bottom of the tub and pumped back to spray nozzles located above the basket. The rinse water is re-circulated for a predetermined length of time before being discharged to drain. See, for example, U.S. Pat. No. 5,167,722. While such systems are effective to reduce water consumption, they increase costs of the machine by employing valves, pumps, conduits etc. that result in additional material and assembly costs.

SUMMARY OF INVENTION

In one aspect, a method for operating a washing machine in a rinse cycle is provided for a washing machine including a rotatable basket and a fresh water spraying device. The method comprises rotating the basket at a first rate of rotation, spraying water into the basket while the basket is rotating at the first rate, and rotating the basket at a second rate of rotation, the second rate of rotation greater than the first rate of rotation.

In another aspect, a method for operating a washing machine in a rinse cycle is provided for a washing machine including a rotatable basket drivingly engaged to a multi-speed drive system, and a spraying device. The method comprises driving the basket at a low speed, spraying fresh water into the basket, terminating spraying into the basket and driving the basket at a high speed.

In another aspect, a method for operating a washing machine in a rinse cycle is provided for a washing machine including a rotatable clothes basket drivingly engaged to a multi-speed drive system, a spraying device, and a drain assembly. The method comprises rotating the basket at a low speed with the drive system, spraying fresh water into the basket with the spraying device, saturating clothes in the basket, continuing to spray fresh water into the basket after the clothes are saturated until a predetermined quantity of water has been sprayed, terminating spraying into the basket, and rotating the basket at a high speed with the drive system.

In another aspect, a washing machine is provided. The washing machine comprises a tub, a basket rotatably mounted within said tub, a multi-speed drive system for rotating said basket at a first speed and a second speed greater than said first speed, a spraying device configured to direct fresh water into said tub, and a controller operatively coupled to said drive system and to said spraying device. The controller is configured to operate said drive system to rotate said basket at the first speed while spraying water fresh into said basket, and to operate said drive system at the second speed after terminating said spraying.

In another aspect, a washing machine is provided. The washing machine comprises a rotatable basket, a multi-speed drive system for rotating said basket at a first speed and a second speed greater than said first speed, a spraying device configured to direct fresh water into said tub, and a controller operatively coupled to said drive system and to said spraying device. The controller is adapted to repeatedly spin said basket at the first speed, spray fresh water into the basket while the basket is rotating at the first speed, and spin the basket at the second speed to extract water from the basket.

In another aspect, a washing machine is provided. The washing machine comprises a rotatable basket, a drive system operatively coupled to said basket for rotating said basket about a vertical axis, a spray device configured to spray water into said basket, and a controller operatively coupled to said drive system and to said spray device. The controller is configured to rotate said basket at least at a first speed in a rinse cycle and to rotate said basket at a second speed greater than the first speed in the rinse cycle. The controller is further configured to spray a predetermined quantity of water each time the basket is rotated at the first speed.

In another aspect, a washing machine is provided. The machine comprises a tub, a basket rotatably mounted within said tub, a multi-speed drive system for rotating said basket at a first speed and a second speed greater than said first speed, a spraying device configured to direct fresh water into said tub; and a controller operatively coupled to said drive system and to said spraying device for execution of a spray rinse cycle during a wash cycle. The controller is configured to operate said drive system to rotate said basket at the first speed while spraying water fresh into said basket and to operate said drive system at the second speed after terminating said spraying when in the spray rinse cycle, and wherein a number of spray rinse cycles in a wash cycle is a function of at least one of a selected load type and a detected load type.

In still another aspect, a washing machine is provided. The machine comprises a tub, a basket rotatably mounted within said tub, a multi-speed drive system for rotating said basket at a first speed and a second speed greater than said first speed, a spraying device configured to direct fresh water into said tub, and a controller operatively coupled to said drive system and to said spraying device for execution of a spray rinse cycle. The controller is configured to monitor an amount of time to fill said tub with a quantity of water, and based upon said amount of time, to operate said spraying device to spray a specific amount of water into said basket during said spray rinse cycle.

DETAILED DESCRIPTION

Figure 1:
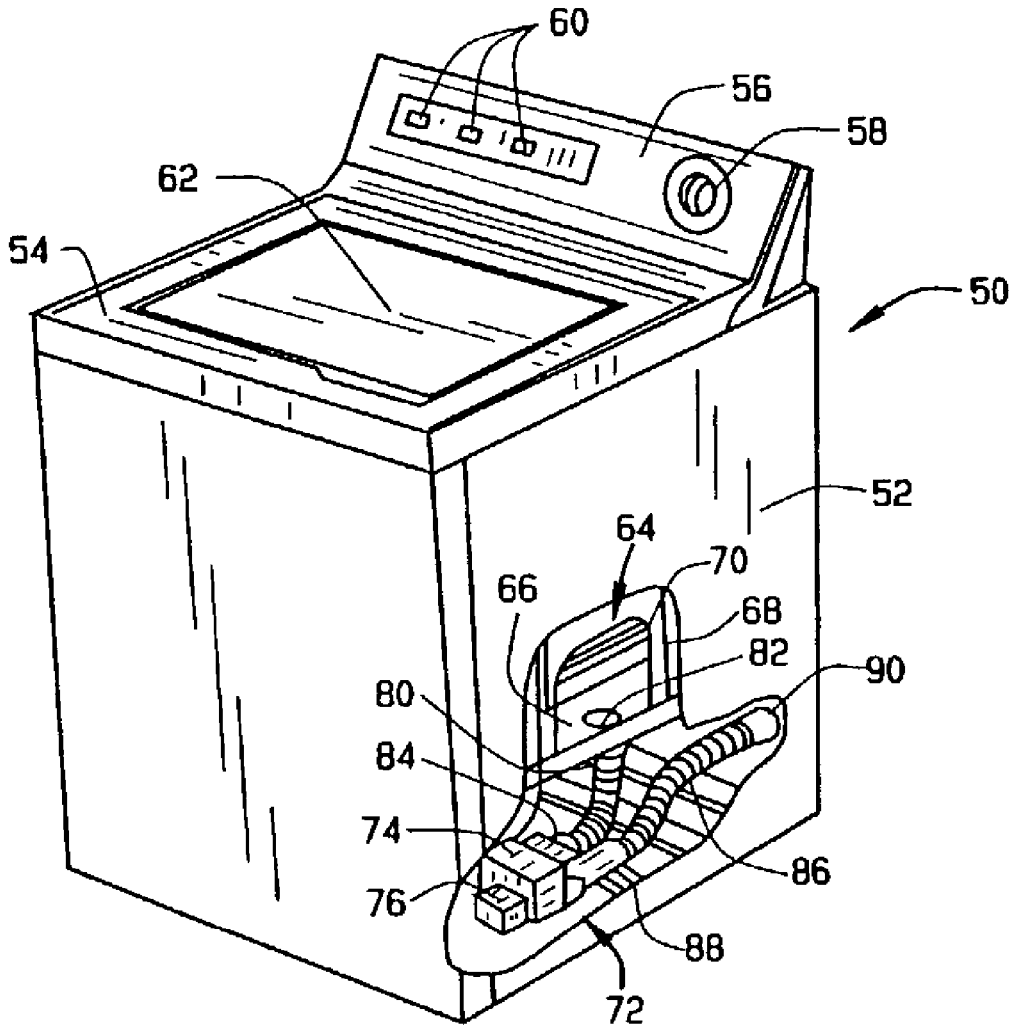
FIG. 1 is a perspective cutaway view of an exemplary washing machine.

FIG. 1 is a perspective view partially broken away of an exemplary washing machine 10 including a cabinet 52 and a cover 54. A backsplash 56 extends from cover 54, and a timer mechanism 58 and variety of appliance control input selectors 60 are coupled to backsplash 56. Timer mechanism 58 and input selectors 60 collectively form a user interface input for operator selection of machine cycles and features. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64. As illustrated in FIG. 1, machine 10 is a vertical axis washing machine. It is contemplated however, that the benefits of the present invention are equally applicable to other types of washing machines, such as horizontal axis machines familiar to those in the art.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74, a motor 76, and in an exemplary embodiment a motor fan (not shown). A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
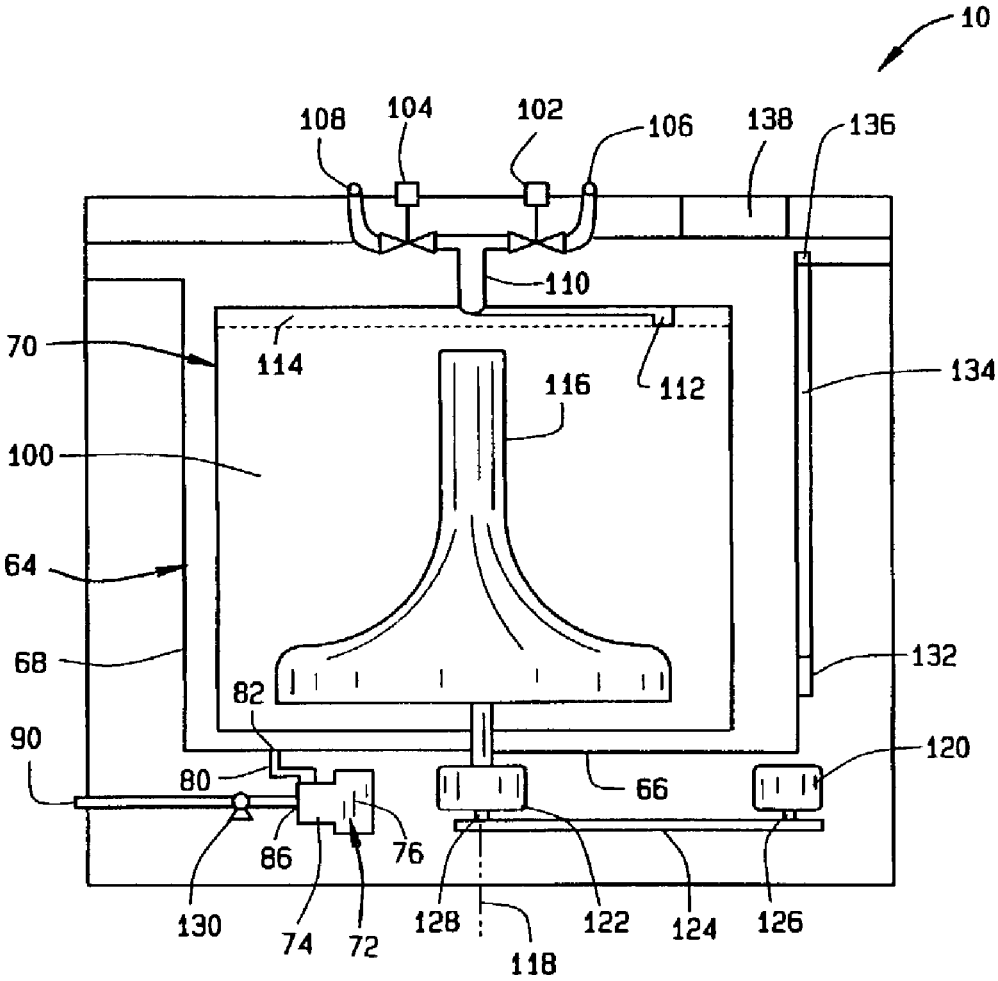
FIG. 2 is front elevational schematic view of the washing machine shown in FIG. 1.

FIG. 2 is a front elevational schematic view of washing machine 10 including wash basket 70 movably disposed and rotatably mounted in wash tub 64 in a spaced apart relationship from tub side wall 68 and tub bottom 66. Basket 12 includes a plurality of perforations therein to facilitate fluid communication between an interior 100 of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 10 and, when connected to a building plumbing system (not shown), provide a fresh water supply for use in washing machine 10. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing or articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitator, impeller, or oscillatory basket mechanism 116 is disposed in basket 70 to impart an oscillatory motion to articles and liquid in basket 70. As illustrated in FIG. 2, agitator 116 is oriented to rotate about a vertical axis 118. It is contemplated, however, that at least some of the benefits of the present invention may apply to horizontal axis washing machines as well.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitator 116 for rotatable movement within wash tub 64, and clutch system 122 facilitates relative rotation of basket 70 and agitator 116 for selected portions of wash cycles Motor 120, transmission and clutch system 122 and belt 124 collectively are referred herein as a machine drive system. As will be appreciated below, the motor drive system is a multiple speed drive in that it is capable of spinning basket 70 at multiple speeds to accomplish different objectives at different points in the wash cycle.

Washing machine 10 also includes a brake assembly (not shown) selectively applied or released for respectively maintaining basket 70 in a stationary position within tub 64 or for allowing basket 70 to spin within tub 64. Pump assembly 72 is selectively activated to remove liquid from basket 70 and tub 64 through drain outlet 90 and a drain valve 130 during appropriate points in washing cycles as machine 10 is used. In an exemplary embodiment, machine 10 also includes a reservoir 132, a tube 134 and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, voltage or current phase shifts, etc.

Operation of machine 10 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 10 to execute selected machine cycles and features.

In an illustrative embodiment, clothes are loaded into basket 70, and washing operation is initiated through operator manipulation of control input selectors 60 (shown in FIG. 1) and timer mechanism 58 (shown in FIG. 1). Tub 64 is filled with water and mixed with detergent to form a wash fluid, and basket 70 is agitated with agitator 116 for cleansing of clothes in basket 70. After a predetermined period of agitation, tub 64 is drained with pump assembly 72.

Unlike conventional machines, washing machine 10 employs a fresh water spin rinse cycle (explained in detail below) to remove detergent from clothes in an effective manner without a conventional deep fill rinse and further agitation to remove detergent from clothes. Further, re-circulation systems for recycling rinse water within tub 64, and the associated expense, are avoided.

Figure 3:
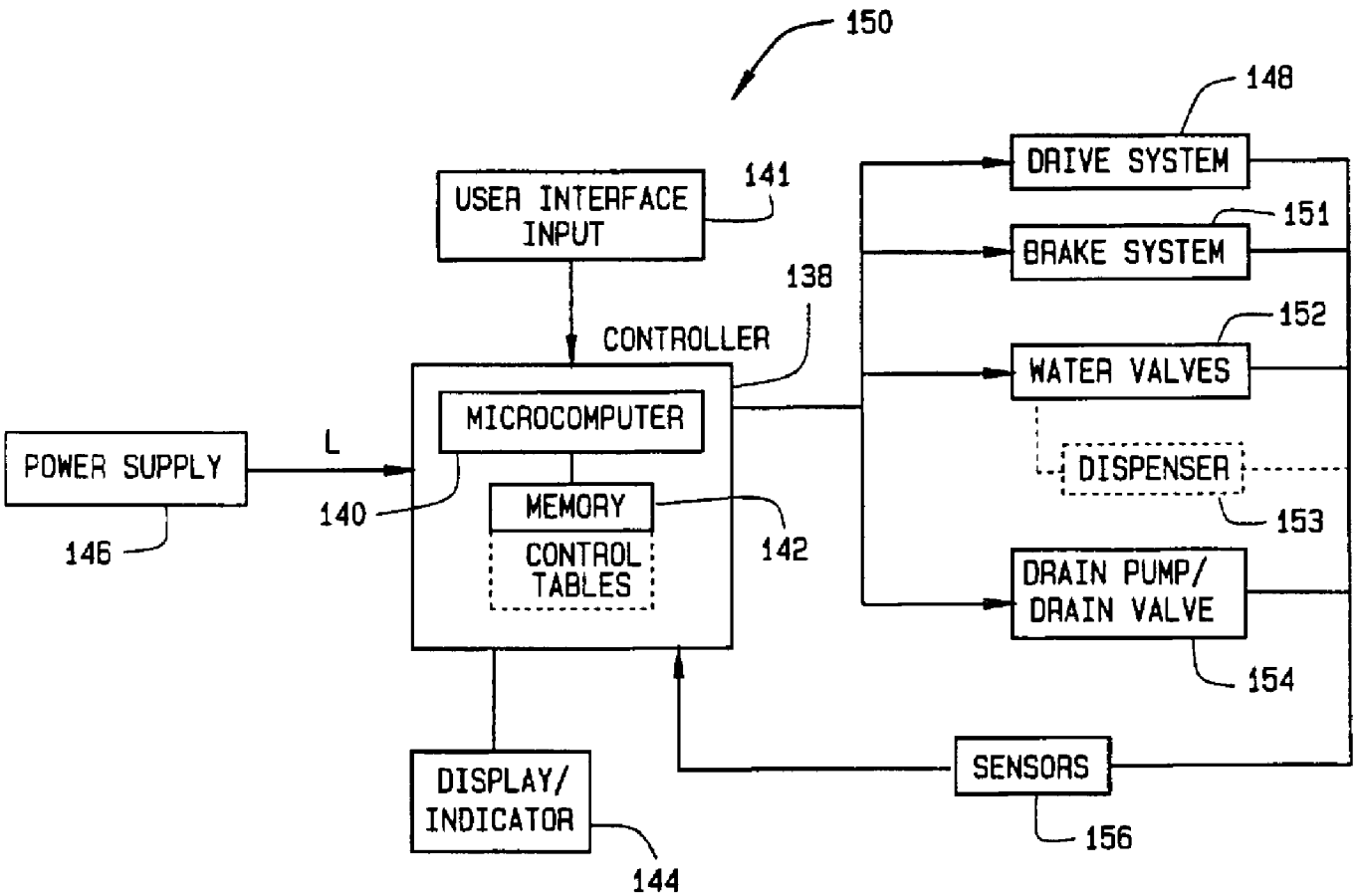
FIG. 3 is a schematic block diagram of a control system for the washing machine shown in FIGS. 1 and 2.

FIG. 3 is a schematic block diagram of an exemplary washing machine control system 150 for use with washing machine 10 (shown in FIGS. 1 and 2). Control system 150 includes controller 138 which may, for example, be a microcomputer 140 coupled to a user interface input 141. An operator may enter instructions or select desired washing machine cycles and features via user interface input 141, such as through input selectors 60 (shown in FIG. 1) and a display or indicator 144 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively couple to machine drive system 148 (e.g., motor 120 and clutch system 122 shown in FIG. 2), a brake assembly 151 associated with basket 70 (shown in FIG. 1), machine water valves 152 (e.g., valves 102, 104 shown in FIG. 1) and machine drain system 154 (e.g., drain pump assembly 72 and/or drain valve 130 shown in FIG. 1) according to known methods. In a further embodiment, water valves 152 are in flow communication with a dispenser 153 (shown in phantom in FIG. 3) so that water may be mixed with detergent or other composition of benefit to washing of garments in wash basket 70 (shown in FIG. 1).

In response to manipulation of user interface input 141 controller 138 monitors various operational factors of washing machine 10 with one or more sensors or transducers 156, and controller 138 executes operator selected functions and features according to known methods. Of course, controller 138 may be used to control washing machine system elements and to execute functions beyond those specifically described herein.

While an electronic controller 138 is described and illustrated in FIG. 3, it is contemplated that known electromechanical control mechanisms may be employed in alternative embodiments while achieving at least some, if not all, of the benefits of the instant invention.

Controller 138 operates the various components of washing machine 10 in a designated wash cycle familiar to those in the art of washing machines. However, and unlike known washing machines, controller 138 executes fresh water spin rinse cycles at multiple basket speeds for removing detergent and water from items in basket (shown in FIGS. 1 and 2) with a reduced amount of water in comparison to conventional washing machines and systems, and without employing expensive fluid re-circulation systems. Potential redeposit of soil on cleaned garments due to re-circulation is therefore avoided. Additionally, agitation of garments in rinse cycles may be avoided, and associated wear on clothes due to agitation is reduced. Rinse cycles may be adjusted for selected or detected load sizes and load types, as further described below.

Figure 4:
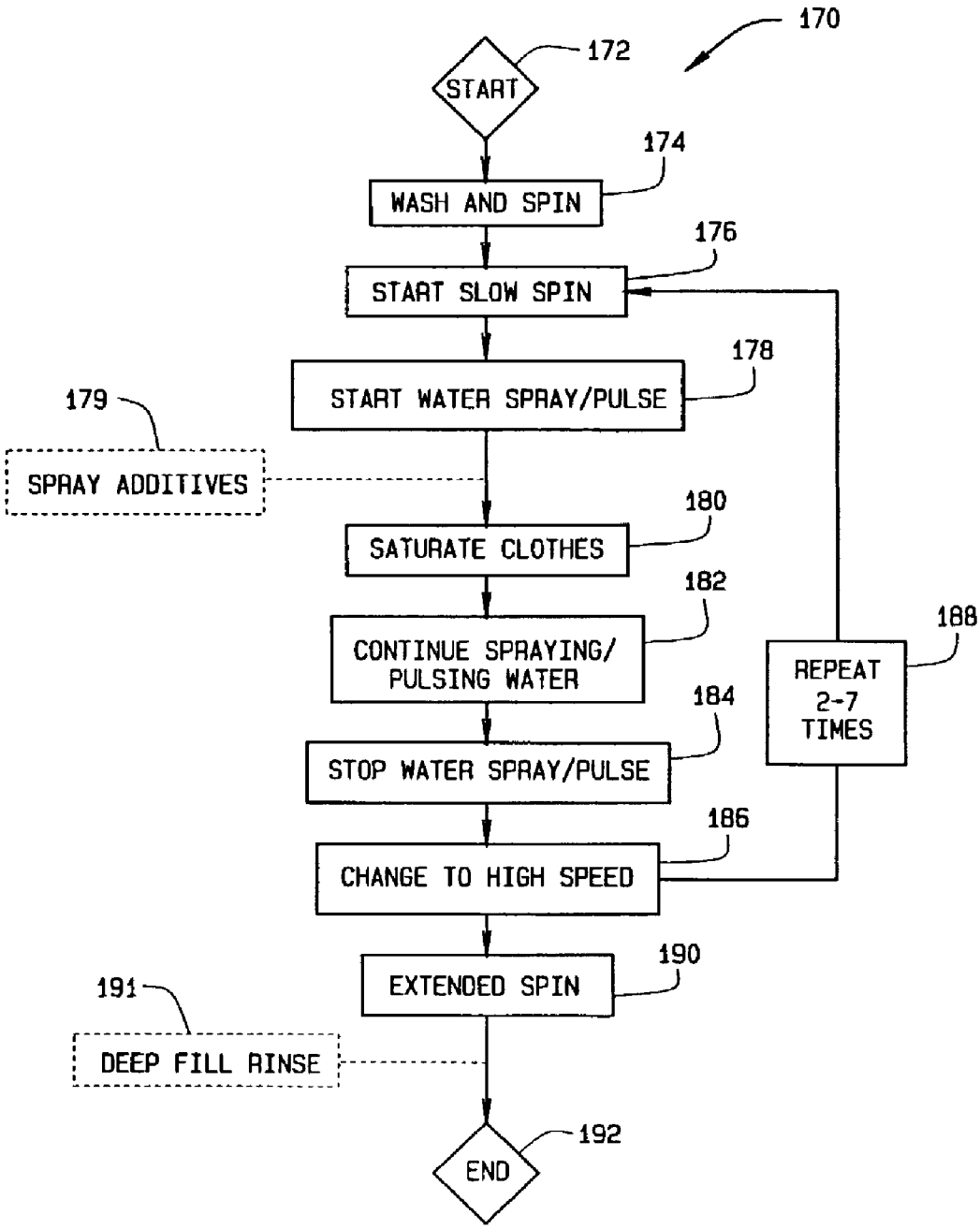
FIG. 4 is a rinse cycle algorithm executable by the controller shown in FIG. 3.

FIG. 4 is an exemplary rinse cycle method algorithm 170 executable by controller 138 (shown in FIG. 3) for achieving effective rinsing of articles in basket 70 (shown in FIGS. 1 and 2) without excessive water usage and while avoiding the expense of a re-circulation system. Algorithm 170 in alternative embodiments may be a user selected option, such as through user manipulation of one of input selectors 60 (shown in FIG. 1), or may be automatically activated or deactivated by machine controls.

Algorithm 170 begins 172 with controller 138 executing 174 a conventional wash and spin portion of a wash cycle. That is, tub 64 is filled with an appropriate amount of water, based either upon operator selection of load size with user input interface 141 (shown in FIG. 3) or a determined load size, such as with pressure sensor 136 (shown in FIG. 1). Detergent is mixed in the water and articles in basket 70 are agitated for a predetermined time. Once agitation is complete, basket 70 is drained with pump system 154 (shown in FIG. 3) and/or drain valve 130 (shown in FIG. 3), and basket 70 is spun at high speed by machine drive system 148 (shown in FIG. 3) to expel water from articles in basket 70.

When articles in basket 70 are washed and spun 174, rinse operations are to begin, and controller 138 commences 176 a low speed spin of basket 70 within wash tub 64. As used herein, references to speed shall refer to a rate of rotation of basket 70. The low speed is selected to be lower than the high speed spin used to extract water from clothes at completion of the wash and spin portion 174 of the cycle. Further, the low speed may vary between different washing machine platforms or vary in response to a load within basket 70 (shown in FIG. 1). In other words, the low speed does not refer to a single or discrete speed, and multiple low speeds may be employed in the same washer or different washers.

Once slow speed spin of basket 70 is initiated, drain system 154 remains activated to drain fluid from wash tub 64, and controller 138 commences spraying 178 articles in basket 70 by activating liquid valves 102 and/or 104 (shown in FIG. 2) and facilitating fresh water flow into basket 70 through nozzle assembly 112 (shown in FIG. 2). In a further embodiment, known additives are included 179 (shown in phantom in FIG. 4) in the water spray to assist in the washing or rinsing process. By rotating basket 70 under the nozzle stream, articles in basket 70 are gradually saturated 180 with fluid, additives or no additives, through a low cost nozzle assembly 112 (shown in FIG. 1), and capillary action in the clothes draws water into the clothes and dilutes detergent from clothes in basket 70 as basket 70 is continually spun 178 at low speed.

While the basket is spun at low speed in an illustrative embodiment when spraying 178 is initiated to obtain spray coverage of the entire basket 70, it is appreciated that in alternative embodiments fresh water may be sprayed from multiple locations into basket 70, such as with multiple nozzles or an integrated spray fill tube, to obtain full spray coverage of basket 70 while basket 70 is stationary. In other words, it is contemplated that the low speed could be zero in an alternative embodiment.

In an exemplary embodiment, the water spray is pulsed or cycled on and off to allow water some time for fresh water to be drawn into basket articles and the spaces between the fibers in the articles. Given a sufficient amount of time, and depending upon spray flow rates and the actual speed of basket spinning, articles in the basket reach an equilibrium state as water is pulsed over them. In the equilibrium state, water passes through the clothes in a steady manner and a detergent removal rate from the clothes is substantially optimized. Additionally, pulsation of the water spray reduces occurrence of suds lock in the machine that can impair washing performance. It is recognized, however, that at least some of the advantages of the invention may be achieved in alternative embodiments without pulsing the water spray.

After the basket articles are saturated 180 with fresh water, controller 138 continues 182 to spray fresh water over articles in basket 70 while basket 70 is spun 178 at low speed. The water spray passes through clothes in basket 70 and carries detergent away from the clothes. Spraying 178 continues for a predetermined time or until a predetermined quantity or amount of fresh water has been sprayed. Spray times or amounts may be inferred from, or in other words may be a function of, a user load size selection or a user selected load type. In further embodiments, load sizes and/or types may be inferred from an implicit measurement of machine operation, such as operating pressure via pressure sensor 136 (shown in FIG. 1), spin torque, motor current, load weight, level sensor, voltage and/or current phase shifts, spin acceleration rates, brake stop time, or other known indicia of load size during wash operations. Specific amounts of water spray may be effectively controlled by estimating water supply pressure (and thus water flow rates) based upon measured tub fill times in machine operation and thereafter adjusting spray times to deliver a specific volume of water.

When basket 70 is sprayed 182 for a predetermined time period or in a predetermined amount, controller 138 terminates 184 spraying operations by closing liquid supply valves 102, 104. Once spray operations are terminated 184, controller signals drive system 148 and changes 186 a basket speed of rotation from the low speed to the high speed. Thus, the rate of rotation of basket 70 is increased from the low speed to the high speed for extracting a greater amount of water from clothes while drain system 154 continues to drain fluid from wash tub 64. High speed spinning of the basket is maintained for a predetermined period of time, and when the predetermined time period has elapsed, controller repeats 188 the fresh water rinse cycle by again commencing 178 the low speed spin of basket 70 and restarting spraying 180 of fresh water over basket 70.

It is recognized that in alternative embodiments, water spray could be terminated after saturating 180 clothes in basket 70 without continued spraying 182 of articles after the saturation point is reached.

In an illustrative embodiment, the low speed, fresh water rinse is repeated 188 two to seven times before a high speed extended spin is initiated 190 to extract water from basket articles for the final time. The number of repeats 188 in various embodiments is predetermined, user selected, or a function of selected or detected load size and load type. After the extended high speed spin 190 is completed, algorithm ends 192 and the wash cycle is either completed or controller 138 continues another wash portion of the cycle.

In a further embodiment, a conventional deep fill rinse 191 (shown in phantom in FIG. 4) is employed before or after the basket is spun 186 at the high speed after spray rinsing. Deep fill rinse 191 in such an embodiment may be user selected. Further, when a rinse input selector is employed with interface input 141 (shown in FIG. 3), the spray rinse cycle may be suspended altogether when a user selects a deep fill rinse over the spray rinse according to algorithm 170. In other words, algorithm 170 is executed when the spray rinse cycle is selected, a deep fill rinse is executed when a deep fill rinse is executed, or a combination of the spray rinse and deep fill rinse cycles may be executed if selected by a user. In such an embodiment clothes and articles in washing machine could be submerged in a deep fill rinse when desired, not submerged when a spray rinse cycle is desired, or clothes and articles could be subjected to both types of rinsing in a single cycle.

It is believed that programming of controller 138 to achieve the instant benefits of the fresh water spin rinse cycle is within the purview of those skilled in art of electronic controllers. Further discussion is therefore omitted.

The above-described fresh water rinse cycle therefore effectively rinses clothes with multiple fresh water rinses and multiple spins while using only about 25% to about 60% of the water used in conventional deep fill rinse machines. In addition, re-circulation components that add additional cost to the machine are avoided. Still further, the rinse cycle does not employ agitation during rinse portions of the wash cycle, thereby reducing wear on the clothes during washing operations.

While the invention has been described in terms of various specific embodiments, those skilled in the art will recognize that the invention can be practiced with modification within the spirit and scope of the claims.

The invention claimed is:

1. A method for operating a washing machine in a rinse cycle, the washing machine including a wash tub, a rotatable basket within the wash tub, the rotatable basket containing clothes to be rinsed, and a water spraying device, said method comprising:

rotating the basket at a first rate of rotation;

spraying fresh water into the basket while the basket is rotating at the first rate;

terminating spray when a saturation point of the clothes is reached; and rotating the basket at a second rate of rotation, the second rate of rotation greater than the first rate of rotation.

2. A method in accordance with claim 1 wherein said spraying water into the basket comprises pulsing the water into said basket.

3. A method in accordance with claim 1 further comprising:

terminating said spraying before rotating the basket at the second rate of rotation; and repeating rotating the basket at the first rate of rotation and spraying water into the basket while the basket is rotating at the first rate of rotation.

4. A method in accordance with claim 1 wherein said rotating the basket comprises rotating the basket about a vertical axis.

5. A method in accordance with claim 1 wherein a quantity of water is a function of a load type.

6. A method in accordance with claim 1 wherein a quantity of water is a function of a load size.

7. A method in accordance with claim 1 further comprising executing a deep fill rinse after rotating the basket at the second rate of rotation.

8. A method in accordance with claim 1 wherein the washing machine includes a user selected rinse selector input, said method further comprising:

executing said rotating the basket at a first rate of rotation, spraying quantity of water into the basket while the basket is rotating at the first rate, and rotating the basket at a second rate of rotation when a spray rinse cycle is selected; and executing a deep fill rinse when a deep fill rinse cycle is selected.

9. A method for operating a washing machine in a rinse cycle, the washing machine including a wash tub, a rotatable basket within the wash tub, the rotatable basket containing clothes to be rinsed, and the rotatable basket drivingly engaged to a multi-speed drive system, and a spraying device, said method comprising:

driving the basket at a low speed;

spraying fresh water into the basket;

terminating spraying into the basket when a saturation point of the clothes is reached; and driving the basket at a high speed.

10. A method in accordance with claim 9 further comprising repeating driving the basket at a low speed, spraying fresh water into the basket, terminating spraying into the basket, and driving the basket at a high speed.

11. A method in accordance with claim 10 wherein spraying fresh water comprises pulsing fresh water.

12. A method in accordance with claim 10 wherein said driving the basket at high speed comprises driving the basket at high speed for a first period of time, said method further comprising driving the basket at the high speed for a second period of time, the second time period longer than the first time period.

13. A method for operating a washing machine in a rinse cycle, the washing machine including a wash tub, a rotatable clothes basket within the wash tub, the rotatable clothes basket containing clothes to be rinsed, and the rotatable clothes basket drivingly engaged to a multi-speed drive system, a spraying device, and a drain assembly, said method comprising:

rotating the basket at a low speed with the drive system;

spraying fresh water into the basket with the spraying device;

saturating clothes in the basket;

terminating spraying into the basket when a saturation point of the clothes is reached ; and rotating the basket at a high speed with the drive system.

14. A method in accordance with claim 13 wherein said spraying fresh water comprises pulsing fresh water.

15. A method in accordance with claim 13 further comprising repeatedly rotating the basket at low speed, spraying fresh water into the basket, saturating clothes in the basket, and rotating the basket at high speed.

* * * * *

UNITED STATES PATENT AND TRADEMARK OFFICE

CERTIFICATE OF CORRECTION

PATENT NO. : 7,017,217 B2
APPLICATION NO. : 10/064499
DATED : March 28, 2006
INVENTOR(S) : Johanski et al.

It is certified that error appears in the above-identified patent and that said Letters Patent is hereby corrected as shown below:

In Claim 1, column 8, line 33, delete “spray” and insert therefor --spraying--.
In Claim 8, column 8, line 61, between “spraying” and “quantity” insert --a--.

Signed and Sealed this

Seventeenth Day of June, 2008

JON W. DUDAS
*Director of the United States Patent and Trademark Office*